US006447186B1

(12) United States Patent
Oguchi et al.

(10) Patent No.: US 6,447,186 B1
(45) Date of Patent: Sep. 10, 2002

(54) PRINTING APPARATUS, CONTROL METHOD THEREOF, AND DATA STORAGE MEDIUM STORING A COMPUTER PROGRAM REALIZING THE CONTROL METHOD

(75) Inventors: Asahiro Oguchi, Okaya; Yuji Takamizawa, Shimosawa-machi; Atsushi Yamaji, Shiojiri, all of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/675,307

(22) Filed: Sep. 29, 2000

(30) Foreign Application Priority Data

Sep. 29, 1999 (JP) ..... 11-277527

(51) Int. Cl.[7] ..... B41J 11/68
(52) U.S. Cl. ..... 400/621; 400/582
(58) Field of Search ..... 400/621, 582

(56) References Cited

U.S. PATENT DOCUMENTS 5,215,393 A 6/1993 Wincent
5,478,161 A 12/1995 Suzuki et al.
5,588,762 A 12/1996 Suzuki
5,649,776 A 7/1997 Sugimoto et al.
5,717,958 A * 2/1998 Oka et al. ..... 396/2
5,921,686 A 7/1999 Baird et al.

FOREIGN PATENT DOCUMENTS

JP 357115542 A * 7/1982
JP 62-116467 5/1987
JP 1-181659 7/1989

* cited by examiner

*Primary Examiner*—Andrew H. Hirshfeld
*Assistant Examiner*—Charles H. Nolan, Jr.
(74) *Attorney, Agent, or Firm*—Michael T. Gabrik

(57) ABSTRACT

Printer control prevents a user from pulling on printed roll paper before the printed form is cut from the roll while still providing the printed paper quickly to the user. When a paper sensor detects the trailing end of printed portion of the paper, that portion of paper is held by an ejection roller pair to temporarily stop the end of the paper from being ejected from the ejection opening. Paper slack in the paper transportation path is then determined. A paper cutting and ejection roller driving sequence is then executed based on the slack determination to provide the printed portion of the paper to the user through the opening.

12 Claims, 7 Drawing Sheets

PRINTING APPARATUS, CONTROL METHOD THEREOF, AND DATA STORAGE MEDIUM STORING A COMPUTER PROGRAM REALIZING THE CONTROL METHOD

BACKGROUND OF THE INVENTION

1. Field of the Invention

The present invention relates to a printer for printing on roll paper, a control method for the printer, and a computer-readable medium embodying a program of instructions for implementing the control method. More particularly, the invention relates to novel way of controlling advancement of the roll paper after printing, which may be embodied in a printer, a control method for such a printer, and/or a computer-readable medium containing an instruction program for the method.

2. Description of the Related Art

Printers used in ATM machines, for example, typically print to roll paper or other type of continuous recording medium, and then cut the printed form to an appropriate length using an automatic paper cutting mechanism. Such printers are often installed in unattended locations, making it very important to minimize the potential for problems arising in conjunction with normal use.

Controlling advancement of the printed paper must be carefully considered in this type of printer. In this type of printer the leading edge of the paper, both after printing is terminated and while printing is in progress, is gradually advanced from the paper exit by the operation that advances the paper for printing. If the user pulls on the end of the paper projecting from the paper exit before the paper is cut by the automatic paper cutting mechanism, print defects or a paper jam can occur.

To prevent such problems, advancement by the ejection rollers provided near the paper exit is temporarily stopped so that the leading edge of the paper does not project from the paper exit. Once cutting the paper is then completed, the ejection rollers resume advancing the form to eject the paper from the paper exit. A problem with this type of printer is that the user must wait to remove the paper because paper advancement does not start until after both printing and then cutting the paper are finished. Another problem with such printers is that it is possible for the paper to be cut too short when little information is printed to the paper, resulting in the paper being cut before the leading edge is advanced to the ejection rollers near the paper exit. In such cases the form may not be ejected from the paper exit and thus be left inside the printer.

OBJECTS AND SUMMARY OF THE INVENTION

An object of the present invention is therefore to resolve the above noted problems by providing a printer that can provide a printed form to the user as soon as possible after printing is terminated, a control method for such a printer, and computer-readable medium carrying a computer program for executing the method.

A further object of the present invention is to provide a printer, a printer control method and instruction program medium that enable a cut form to be reliably ejected from the paper exit even when little content is printed to the paper.

To achieve these objects, the present invention provides, in one aspect, a printer control method. The method comprises the steps of (a) printing to a print medium; (b) transporting the print medium printed in step (a) toward a print medium ejection opening; (c) holding a leading end part of the print medium at a predetermined position upstream of the print medium ejection opening to stop the transportation of the print medium, so as to produce slack in the print medium; (d) cutting the print medium to separate the print medium printed in step (a) from the remaining part of the print medium; and (e) releasing, before completion of step (d), the holding of the print medium in step (c) to resume transporting the print medium toward the print medium ejection opening.

Printer throughput can be improved by controlling the printer in this way because form ejection starts without waiting for the paper cutting operation to finish.

While ejecting the paper starts with this control method before the roll paper is completely cut, prohibiting paper ejection while printing is in progress produces an accumulation of paper (slack) inside the printer in the paper transportation path between the paper cutter and the paper exit. Therefore, even if the leading end of the paper is exposed from the paper exit before paper cutting is finished and the user pulls on the exposed leading end, this will not immediately cause a paper cutting defect or contribute to a paper jam.

Step (e) in the above printer control method preferably includes the steps of (i) measuring an amount of slack produced in the print medium; (ii) comparing the amount of slack measured in step (i) with a specific value; (iii) resuming transportation of the print medium toward the print medium ejection opening at a first speed if the amount of slack measured in step (i) is more than the specific value; and (iv) resuming transportation of the print medium toward the print medium ejection opening at a second speed that is slower than the first speed if the amount of slack measured in step (i) is less than the specific value.

Preferably this control method additionally comprises the steps of detecting whether the print medium has reached the print medium stopping position near the print medium ejection opening before carrying out step (d); and advancing the print medium to the stopping position if, based on the result of detecting step, the print medium has not reached the stopping position.

By thus providing these steps the printed form can be reliably ejected from the printer even when the area printed on the paper is short.

Preferably, the stopping of the print medium in step (c) is accomplished by stopping rotation of an ejection roller disposed upstream of the print medium ejection opening, and the releasing and resuming of print medium transportation in step (e) is accomplished by starting rotation of the ejection roller.

The present invention may be embodied in a printer comprised so as to accomplish the printer control method described above. The present invention may also be embodied in a computer-readable medium that carries a program of instructions for implementing the control method.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

REFERENCE NUMERAL KEY

Figure 1:
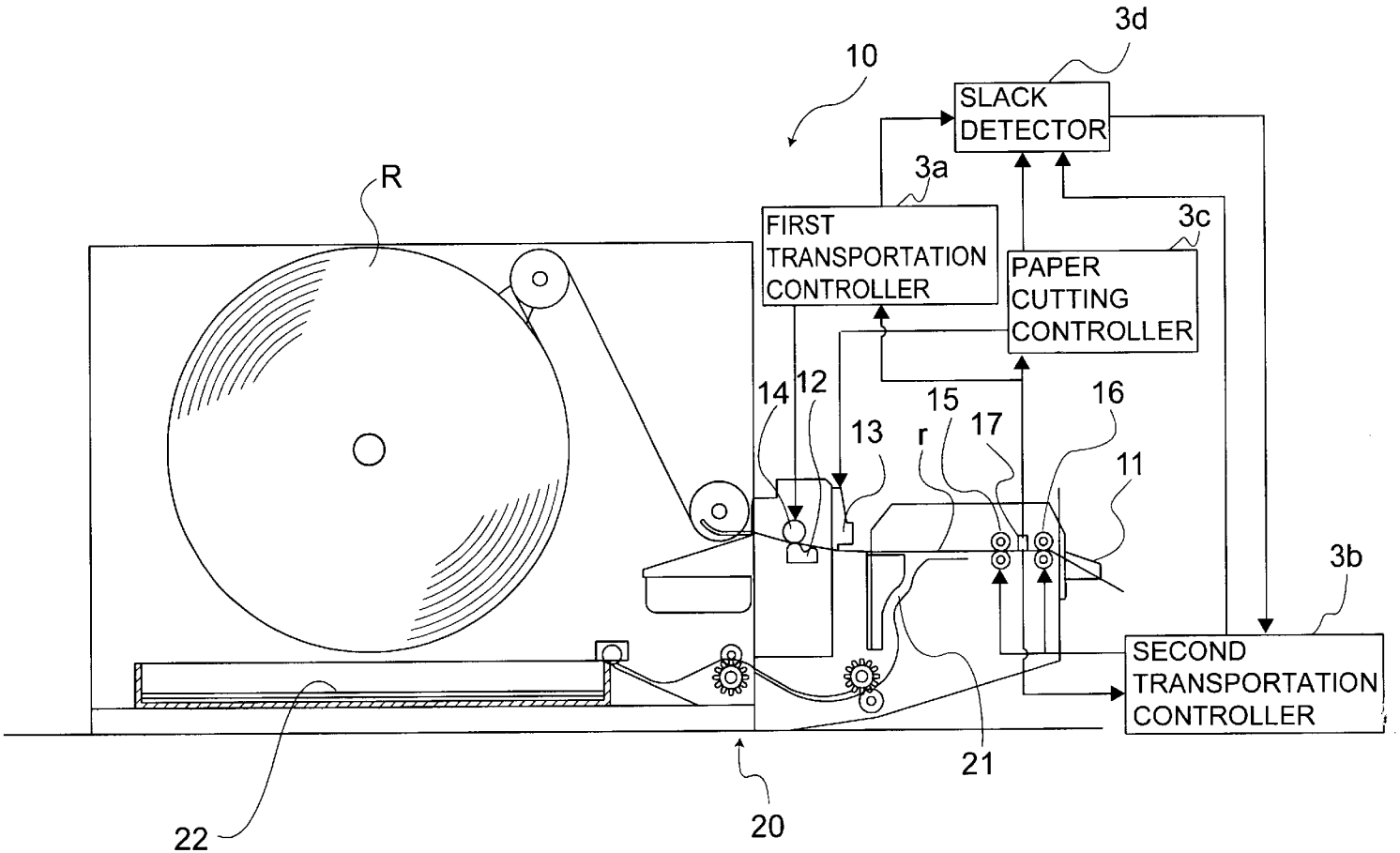
FIG. 1 is a side sectional view showing the internal structure of a printer, in accordance with an embodiment of the invention.

10 printer
11 paper exit
12 print head
13 cutting mechanism
14 feed roller
15 ejection rollers
16 ejection rollers
17 paper sensor
20 recovery unit
21 recovery path
22 recovery tray
R roll paper
r paper

DESCRIPTION OF THE PREFERRED EMBODIMENTS

Preferred embodiments of the present invention are described below with reference to the accompanying figures, of which FIG. 1 is a side sectional view showing the internal structure of a printer according to a first embodiment of the invention. It should be noted that the controllers are represented as functional blocks with the relationship between controller and controlled parts shown in the figure.

A printer 10 according to this preferred embodiment of the present invention is installed, for example, in an ATM machine for printing transaction receipts. The printer 10 holds a roll of paper R inside the printer for printing; this roll paper R is the preferred print medium in this embodiment.

A paper path is formed between a housing in which roll paper R is contained and the roll paper exit 11. Disposed along this paper path are print head 12 for printing on roll paper R, cutting mechanism 13, feed-side ejection roller (referred to below as feed roller) 14, and ejection side ejection rollers 15 and 16 (referred to below as ejection rollers). Note that feed roller 14 and ejection rollers 15 and 16 are together referred to as transportation rollers. In the present embodiment, a thermal line type of print head is used as the print head 12 and the feed roller 14 also acts as a platen for supporting the roll paper against the print head 12. Furthermore, cutting mechanism 13 is disposed near the print head 12 on the downstream side thereof in the direction of roll paper R transportation for cutting the printed roll paper R to form a slip of receipt. Feed roller 14 transports roll paper R printed by print head 12 toward paper exit 11. Ejection rollers 15 and 16 are controlled to hold the roll paper R advanced thereto by feed roller 14 so that the leading end of the paper does not pass out from the paper exit 11, or to continue advancing the roll paper R to, and out of, the paper exit 11.

Figure 6:
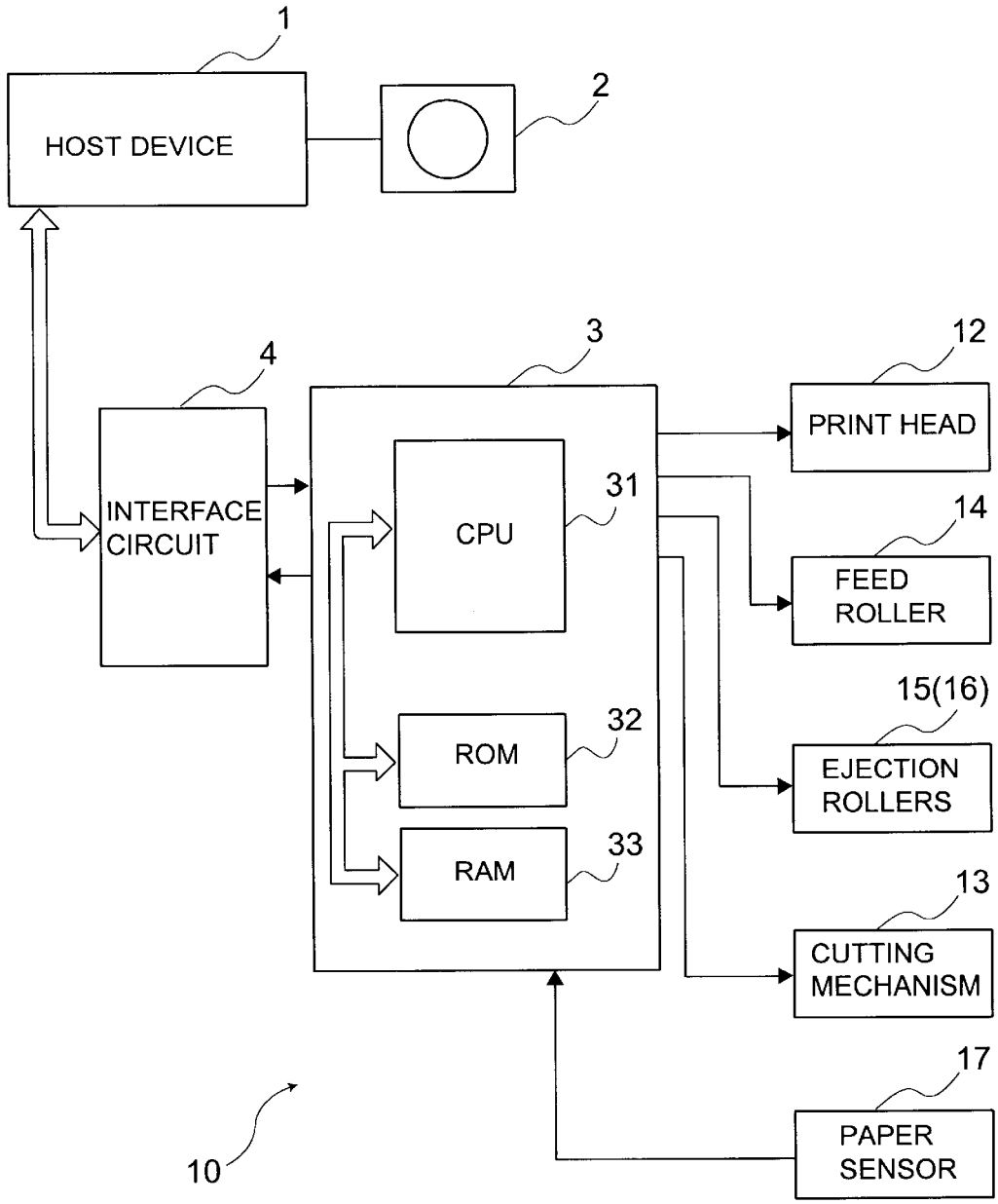
FIG. 6 is a functional block diagram of a printer, a host device, and an interface circuit, in accordance with an embodiment of the invention.

These transportation rollers are driven appropriately according to a print command from the host 1 shown in FIG. 6 to advance the roll paper R gradually from the roll. Print head 12 is driven in conjunction with advancement of the roll paper R by feed roller 14 to print the desired text, symbols, or graphics to the roll paper R according to the received print command. The printed area of roll paper R is further advanced toward the paper exit 11 by feed roller 14, which is controlled by first transportation controller 3*a*, as printing progresses. When the trailing end part of the printed area reaches a specific position, the form is cut by cutting mechanism 13 under the control of paper cutting controller 3*c* so that a single cut receipt can be presented from the paper exit 11 to the user such as an operator or a customer.

The preferred cutting mechanism 13 has a fixed blade and a movable blade with the paper transportation path disposed therebetween. The movable blade is driven by a motor, for example, to cut the paper advanced between the movable blade and fixed blade.

Ejection rollers 15 and 16 are controlled by a second transportation controller 3*b* to grab the leading end part of roll paper R advanced by feed roller 14, and guide the paper to paper exit 11. Ejection rollers 15 and 16 normally advance roll paper R at the same speed as feed roller 14. This means that when feed roller 14 and ejection rollers 15 and 16 are driven, no tension is applied to the roll paper R between feed roller 14 and ejection rollers 15 and 16, and no excessive slack occurs.

For convenience of the following explanation, the part of roll paper R on the paper exit 11 side of the paper cutting position of cutting mechanism 13 is referred to below as paper r. After being cut by cutting mechanism 13, paper r starts being advanced by ejection rollers 15 and 16, and substantially all of paper r is advanced outside of paper exit 11. Finally, ejection rollers 16, which are on the downstream side in the paper feed direction of the ejection rollers 15, keeps holding the trailing end of paper r with less holding force than the upstream ejection rollers 15. This configuration can be simply achieved by setting the strength of the spring (not shown in the figure) that urges the drive roller relative to its corresponding follower in each roller pair to achieve the desired roller pressure relationship.

As further described below, the trailing end part of the cut paper r is finally held by downstream ejection rollers 16. The paper r can then be easily pulled out from paper exit 11 by the user because it is weakly held by ejection rollers 16. As they relate to the control method of an embodiment of the present invention, second transportation controller 3*b* controls ejection rollers 15 and 16 and first transportation controller 3*a* controls feed roller 14 such that ejection rollers 15, 16 and feed roller 14 are driven and stopped independently of each other. Those skilled in the art can realize the above roller driving mechanism by utilizing two independent drive sources such as DC motors or by connecting the transportation rollers to a common drive source via respective clutch mechanisms. This control method is described in further detail below.

Printer 10 further has a paper sensor 17 disposed between the two pairs of ejection rollers 15 and 16. Paper sensor 17 detects the leading edge part of the roll paper R as it is advanced passed upstream ejection rollers 15, and then detects the trailing edge part of the roll paper R when it passes by. Paper sensor 17 outputs detection signals to first and second transportation controllers 3*a*, 3*b* and paper cutting controller 3*c*, which use the supplied detection signals to accomplish various control steps according to an embodiment of the present invention.

As more fully described below, slack is created in paper r between feed roller 14 and ejection roller 15 when second transportation controller 3*b* stops ejection rollers 15, 16 and first transportation controller 3*a* drives feed roller 14. The amount of slack, that is, the accumulation of paper between these rollers, is measured by a slack detector 3*d* based on the amount these respective transportation rollers are stopped and driven by the first and second transportation controllers. More specifically, when the second transportation controller 3*b* stops rotation of the ejection rollers 15, 16 in response to detection of the leading edge of paper r by the paper sensor 17, the slack detector 3*d* resets a slack counter. Then, the slack detector 3*d* starts the slack counter to count an amount of the roll paper R transportation reported by the first transportation controller 3*a*.

Printer 10 yet further has a recovery unit 20 for recovering cut receipts left in the paper exit 11. More specifically, when a receipt is detected as having been left in the paper exit 11 for a predetermined period, or a predetermined command is received from host device 1, ejection rollers 15 and 16 are driven in reverse to draw the cut receipt back into printer 10. The retrieved receipt is guided by a transportation path switching mechanism not shown to recovery path 21 and from there is deposited into recovery tray 22.

As shown in FIG. 6, printer 10 includes a controller 3 that comprises CPU 31, ROM 32, and RAM 33. The printer CPU 31 runs a control program stored in ROM 32, and controls various electrical and mechanical components of the printer according to data such as control commands and print data received by way of interface circuit 4 from host device 1, which is typically a host computer. As it relates to an embodiment of the present invention, printer CPU 31 functions as first and second transportation controllers 3*a*, 3*b* and paper cutting controller 3*c* for driving and controlling feed roller 14, ejection rollers 15, 16, and cutting mechanism 13, respectively, and also functions as the above-noted slack detector 3*d*, in conjunction with a control program stored in ROM 32.

It will be appreciated by one skilled in the art that the control program stored in ROM 32 can be changed by using an EEPROM or similar rewritable non-volatile memory device for ROM 32 and rewriting the control program as needed. In this case it is possible to download the control program to ROM 32 by way of interface circuit 4 from a hard disk drive or other storage device in host device 1, an external storage device connected to the host, or from a server connected via a network or Internet connection.

Figure 2A:
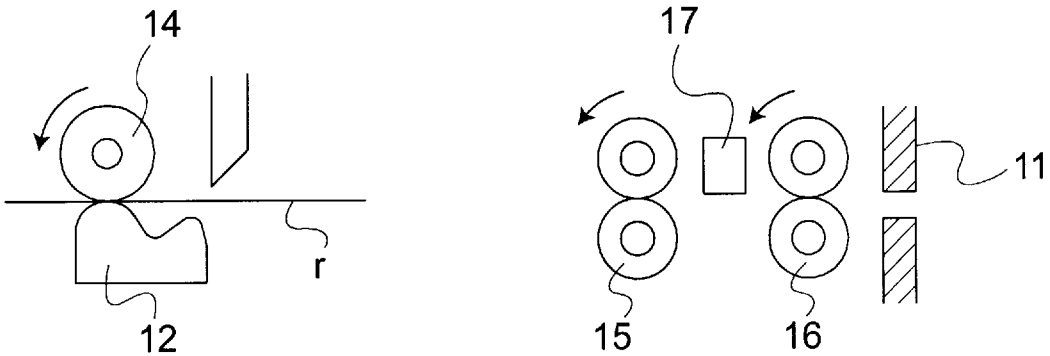
FIGS. 2A–2C are schematic side views of the paper ejection area of the printer at different stages in the paper ejection control process, according to an embodiment of the invention.
Figure 2B:
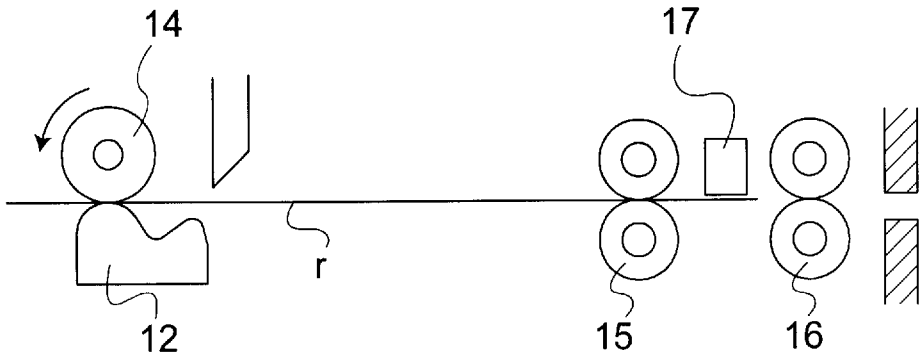
Figure 2C:
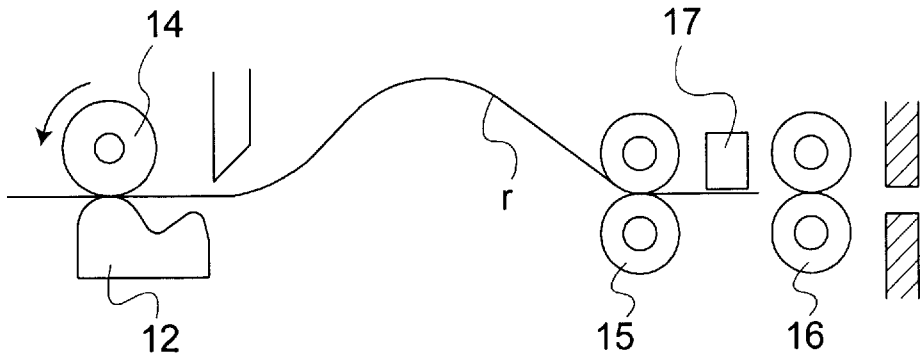
Figure 3D:
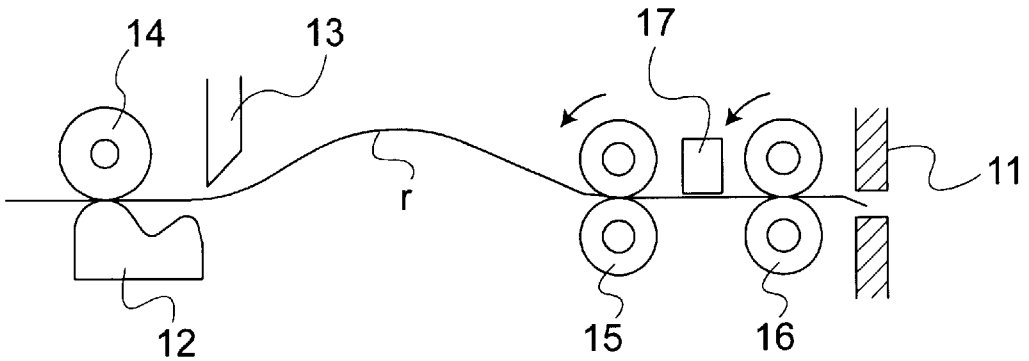
FIGS. 3D–3F are schematic side views of the paper ejection area of the printer at different stages in the paper ejection control process, according to an embodiment of the invention.
Figure 3E:
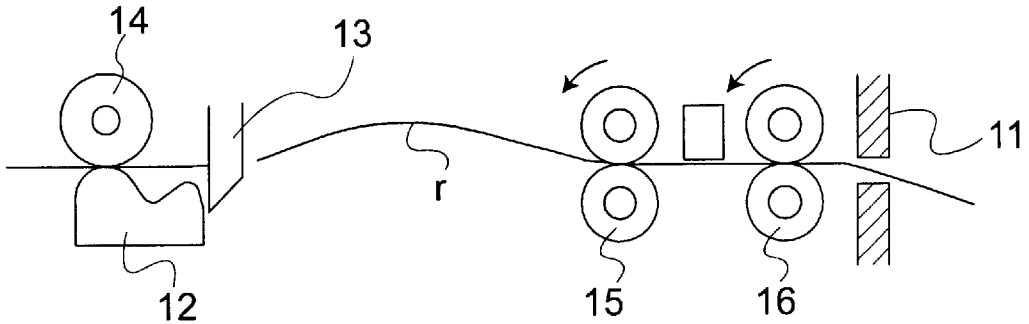
Figure 3F:
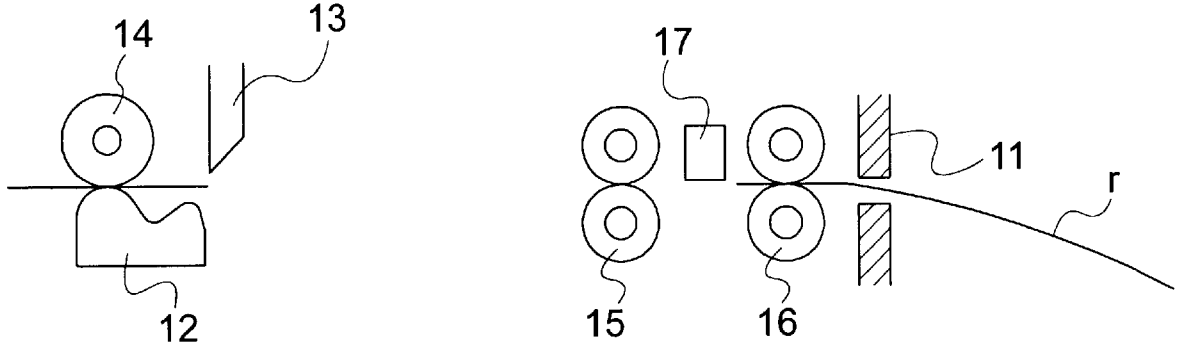
Figure 4:
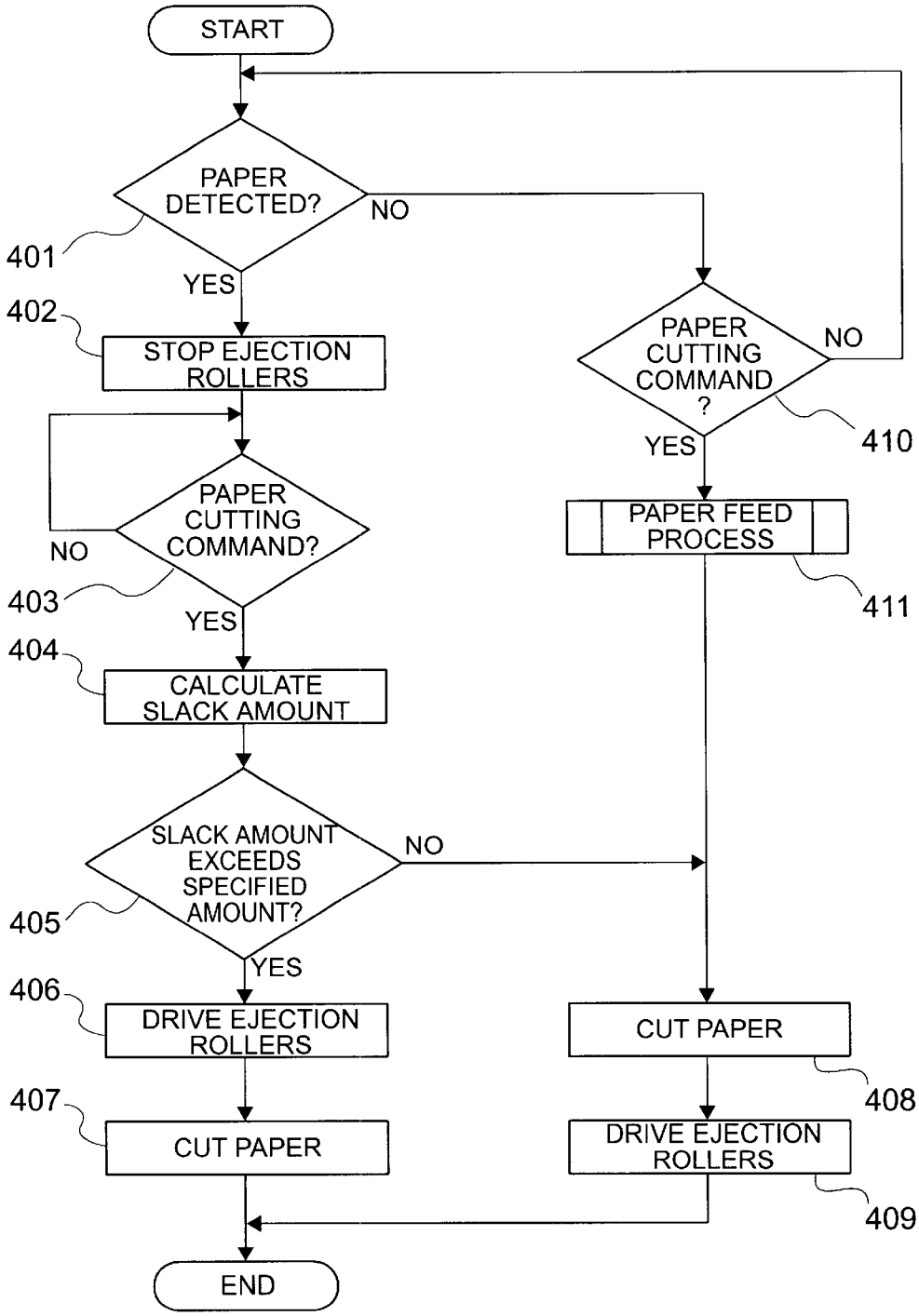
FIG. 4 is a flow chart illustrating a control method, in accordance with an embodiment of the invention.

FIGS. 2A to 2C and FIGS. 3D to 3F are schematic side views of the paper ejection area of the printer at various stages in paper r ejection control according to the present embodiment of the present invention, and FIG. 4 is a flow chart of the control method of the embodiment. Ejection control in a printer 10 according to an embodiment of the present invention is described next below with reference to these figures.

When printer 10 receives data from the host 1 by way of interface circuit 4, printer 10 stores the data temporarily to a receive buffer in RAM 33 of controller 3. A data interpreter realized by CPU 31 and the control program then sequentially interprets the data from the buffer in a FIFO manner. If the received data is a print command, the CPU 31 drives feed roller 14 (first transportation mechanism) to advance roll paper R, and drives print head 12 to print the print data according to the print command to paper (FIG. 2A).

The CPU 31, which functions as the second transportation controller 3*b* for this operation, also drives ejection rollers 15 and 16 (second transportation mechanism) at this time synchronized to feed roller 14. Note that the direction of roller operation at this time is indicated by the arrows in FIGS. 2 and 3. Roll paper R is thus gradually advanced toward paper exit 11 in conjunction with this printing operation.

When the leading edge of the paper reaches the upstream ejection rollers 15, drive force from the ejection rollers 15 continues to advance the paper to the downstream side (FIG. 2B). When the leading edge of roll paper R passes ejection rollers 15, paper sensor 17, disposed on the downstream side of ejection rollers 15, detects the paper (step 401 in FIG. 4) and passes a detection signal to the CPU 31. When the CPU 31 detects this signal, the CPU pauses driving ejection rollers 15 and 16 (step 402). When ejection rollers 15 thus stop, the leading end of paper r remains held therebetween.

Printing by print head 12 continues. CPU 31 functioning as first transportation controller 3*a* controls feed roller 14 to advance roll paper R until printing according to the print command or print data has ended. Because the leading part of the paper is stopped by ejection rollers 15 at this time, paper r gradually slackens upward forming a mushroom shape between ejection rollers 15 and cutting mechanism 13 downstream of the printing unit as shown in FIG. 2C. CPU 31 also begins to calculate how much paper accumulates between feed roller 14 and ejection rollers 15. It should be noted that how much paper has accumulated can be easily calculated from the distance feed roller 14 advances paper r after ejection rollers 15, 16 are stopped as explained above.

The host computer also sends a cut command requiring the printer 10 to cut the paper r following the print data for one receipt. Note that this command is also equivalent to a command terminating printing for one receipt. When the data interpreter of the CPU detects a paper r cut command (step 403, FIG. 4), the CPU starts the printing termination process.

First, the length of paper r advanced since ejection rollers 15 stopped, that is, the amount of slack in paper r between feed roller 14 and ejection rollers 15, is calculated (step 404). If the calculated slack amount is greater than a specific value (step 405), steps 406 and 407 are then carried out. If the calculated slack amount is less than or equal to this specific value, then steps 408 and 409 are executed.

The control processes shown in FIGS. 3D to 3F occur when the calculated slack amount is greater than the specific value and steps 406 and 407 are accomplished. That is, when the calculated slack amount is greater than the specific value, ejection rollers 15 and 16 drive starts (406). This causes the leading end of the paper r to pass outside from paper exit 11 as shown in FIG. 3D, and thus reduces the slack amount, that is, the bulge, of paper r between feed roller 14 and ejection rollers 15. The cutting mechanism 13 is then driven (407) to cut the trailing end of paper r and thus separate the receipt from the upstream non-printed part of roll paper R (FIG. 3E). It should be noted that paper r is completely cut before the paper bulge is completely eliminated.

It should be noted that in this exemplary embodiment of the present invention the driving of cutting paper r in step 407 occurs after driving ejection rollers 15 and 16 starts in step 406; however, the invention is not limited to this order. More specifically, as long as driving ejection rollers 15 and 16 starts before cutting paper r is finished, it does not matter whether the start of driving ejection rollers 15 and 16 or the start of driving cutting mechanism 13 occurs first. For example, the paper r cutting operation can start immediately after the cutting command is interpreted, that is, detected (step 403). Furthermore, this makes it possible to shorten the total processing time compared with starting to drive ejection rollers 15 and 16 after completion of cutting paper r.

In an exemplary embodiment of the present invention, the specific paper slack amount is desirably 50 mm for a printer in which ejection roller 15 advances paper r at 100 mm/s and cutting mechanism 13 requires a maximum of 500 ms to cut the paper. As shown in FIG. 3F, paper r severed from roll paper R by cutting mechanism 13 is advanced to the outside of the printer from paper exit 11 by ejection rollers 15 and 16. When paper sensor 17 detects that the trailing edge of the paper r has passed, driving ejection rollers 15 and 16 stops. The trailing end of paper r is thus held weakly by ejection roller 16 as explained before, and the user can easily remove the paper r from the paper exit 11.

If the slack amount of paper r is less than the specific amount in step 405, cutting mechanism 13 is driven first to cut paper r (step 408), and after completion of cutting paper r, then ejection rollers 15 and 16 are driven to start ejecting paper r from paper exit 11 (step 409). This control sequence prevents the paper from tearing at the paper cutter and also prevents paper from jamming when the ejection rollers 15 and 16 pull on the paper r before cutting the paper is finished when the slack amount of paper r is not sufficient. The control steps 408 and 409 are used when only a small amount of data is printed to one receipt are described next.

If a cut command is detected (step 410) before paper sensor 17 detects the leading edge of paper r in step 401 (FIG. 4), and thus before ejection rollers 15 grasp paper r, control moves to a paper feed process (step 411). This process solves the problem of the receipt being left inside the printer as a result of cutting mechanism 13 cutting the paper before ejection rollers 15 grasp paper r.

Figure 5:
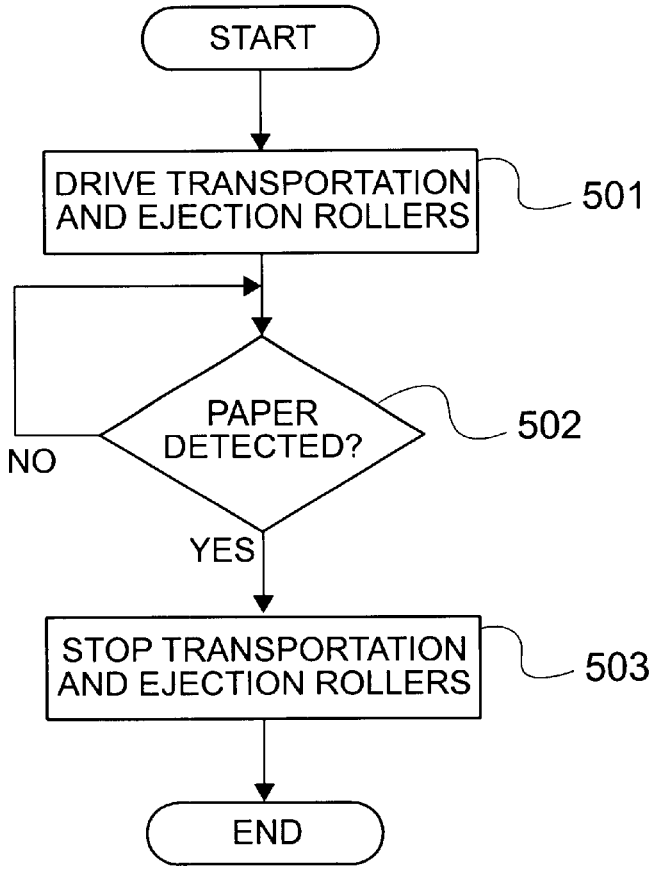
FIG. 5 is a flow chart further elaborating on a portion of the control method illustrated in FIG. 4.

FIG. 5 is a flow chart of this paper feed process performed in step 411 of FIG. 4. If a cut command is applied to the CPU 31 (step 410) before paper sensor 17 detects paper r, CPU 31 drives feed roller 14 and ejection rollers 15 and 16 to begin advancing paper r (step 501). When the leading edge then passes ejection rollers 15 and is detected by paper sensor 17, paper sensor 17 sends a detection signal to the CPU 31 (step 502). When the CPU detects this paper detection signal, it stops driving feed roller 14 and ejection rollers 15 and 16 (step 503). This sequence of steps assures that the leading end of paper r is held by ejection rollers 15 before paper r is cut. Control then passes to step 408 in FIG. 4 whereby cutting paper r is completed. Ejection rollers 15 and 16 are then driven (step 409) to advance paper r from paper exit 11.

An alternative embodiment of the present invention is described next below. This embodiment differs from the above only in the paper ejection process, or more specifically in the process used when the accumulated slack is less than the specific amount. Other aspects are the same as in the first embodiment above. The ejection process is therefore described next below, and further description of like aspects is omitted.

Figure 7:
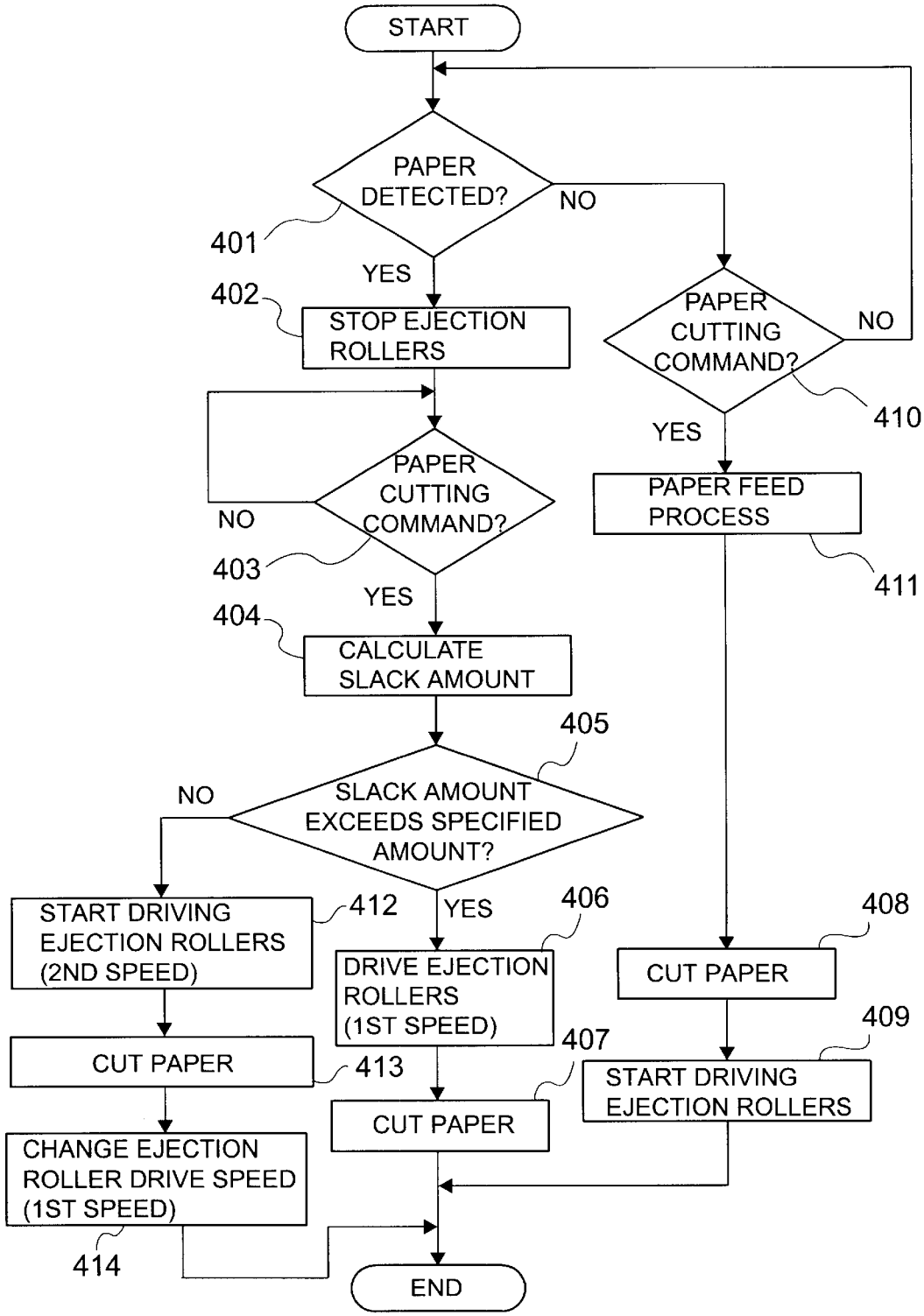
FIG. 7 is a flow chart illustrating a control method, in accordance with another embodiment of the invention.

FIG. 7 is a flow chart of the ejection process in the present embodiment. Like steps in FIG. 7 and FIG. 4 are identified by like reference numerals, and further description thereof is omitted below.

As noted above, CPU 31 measures the slack amount (step 404) and compares the measured slack amount with a specific value (step 405). If the measured slack amount is equal to or greater than the specific value, driving ejection rollers 15 and 16 starts (step 406). The ejection rollers are driven at this time at a first speed or accelerated to this first speed. Subsequent control steps are as shown in FIG. 4 and described above.

However, if the measured slack amount is less than this specific value (step 405), driving ejection rollers 15 and 16 begins in a second speed, which is slower than the first speed, or accelerated to this second speed (step 412). After the driving of ejection rollers 15 and 16 is commenced in step 412, paper r is cut from roll paper R (step 413). After cutting paper r is completed, the drive speed of ejection rollers 15, 16 is changed to the first speed or accelerated to the first speed (step 414). It should be noted that completion of paper r cutting can be detected using a movable blade position sensor (not shown in the figure) disposed relative to the paper cutting mechanism. It is also possible for a timer built into the CPU to measure the maximum time required for the cutting mechanism 13 to cut the paper, and issue a timer interrupt to control the timing at which ejection roller speed is to change in step 414.

In an exemplary embodiment the specific value to which the measured slack amount is compared in step 405 is 50 mm and the second speed at which the ejection rollers are driven in step 412 is 20 mm/s, when the maximum time required for the cutting mechanism 13 to cut the paper is 500 ms and the first transportation speed in step 406 is 100 mm/s. In this case the minimum amount of slack is 10 mm by design, and tears at the paper cut are allowed when the slack in paper r is less than 10 mm.

Furthermore, while cutting paper r begins after the start of driving ejection rollers 15 and 16 in step 406 or 412, the present invention is not limited to this sequence. That is, regardless of how much slack has accumulated, cutting paper r can start at any time after the cut paper command is detected in step 403, as long as ejection rollers 15 and 16 start transporting paper r before cutting the paper r ends.

Paper jams, tears, and other problems caused by conflict between cutting and transporting the paper can be avoided by thus lowering the paper r transportation speed when the slack amount is not sufficient.

Furthermore, although the slack is compared with a single specific value, and the paper transportation speed is set to one of two speeds based on this slack amount comparison in this embodiment, the present invention is not limited to these numbers. More specifically, paper slack can be compared with a plurality of specific values to select the transportation speed from among three or more speeds. In this case a table defining the relationship between slack amount ranges and transportation speeds is preferably used.

Although embodiments of the present invention have been described with reference to the accompanying drawings, various changes and modifications will be apparent to those skilled in the art. For example, an embodiment of the present invention is described above using two pairs of ejection rollers, referred to as the upstream and downstream ejection rollers above, but it is possible to achieve the present invention using only one pair of ejection rollers. Such changes and modifications are to be understood as included within the scope of the present invention as defined by the appended claims, unless they depart therefrom.

As will be apparent from the above description, the present invention prevents the user from pulling on the paper before the paper is completely cut and yet can still provide the printed paper to the user quickly after printing is terminated.

Furthermore, problems such as paper tears and paper jams that occur as a result of the user pulling on the paper while it is being cut, and conflict between paper cutting and paper transportation operations, can be avoided and prevented by cutting the paper before advancing the paper, or by slowing the paper feed rate to the paper exit when there is not sufficient amount of slack formed by stopping roll paper ejection while printing is in progress.

Moreover, a printer and printer control method according to the present invention can reliably eject the cut printed form from the paper exit even when the printed area of the paper is small.

What is claimed is:

1. A printer control method, comprising the steps of:

(a) printing to a print medium;

(b) transporting the print medium printed in step (a) toward a print medium ejection opening;

(c) pausing the transportation of the print medium, so as to produce slack in the print medium;

(d) cutting the print medium to separate the print medium printed in step (a) from the remaining part of the print medium; and (e) resuming the transportation of the print medium toward the print medium ejection opening, before completion of step (d).

2. A printer control method according to claim 1, wherein step (e) comprises the steps of:

(e)(1) measuring an amount of slack produced in the print medium;

(e)(2) comparing the amount of slack measured in step (e)(1) with a specific value;

(e)(3) resuming transportation of the print medium toward the print medium ejection opening at a first speed if the amount of slack measured in step (e)(1) is more than the specific value; and (e)(4) resuming transportation of the print medium toward the print medium ejection opening at a second speed slower than the first speed if the amount of slack measured in step (e)(1) is less than the specific value.

3. A printer control method according to claim 2, further comprising the step of:

(f) changing, after completion of step (d), the transportation speed of the print medium set in step (e)(4) to the first speed.

4. A printer control method according to claim 1, wherein:

in step (c), the stopping of the print medium is accomplished by stopping rotation of an ejection roller disposed upstream of the print medium ejection opening, and in step (e), the releasing and resuming of print medium transportation are accomplished by starting rotation of the ejection roller.

5. A printing apparatus, comprising:

a print head for printing on a print medium;

an ejection opening through which the print medium printed on by the print head is ejected;

a cutter disposed downstream of the print head for cutting the print medium and separating a printed part of the print medium from the remaining part thereof;

a first transportation roller for transporting the print medium printed on by the print head toward the ejection opening; and a second transportation roller disposed between the first transportation roller and the ejection opening for selectively performing one of holding the print medium transported by the first transportation roller and transporting the print medium to the ejection opening;

wherein the second transportation roller begins transporting the print medium to the ejection opening before the cutter completes cutting the print medium when the printing on the print medium has ended.

6. A printing apparatus according to claim 5, further comprising a slack amount detector for measuring an amount of slack produced in the print medium, wherein the print medium transportation controller controls the second transportation roller to transport the print medium to the print medium ejection opening at a first speed when the amount of slack measured by the slack amount detector is greater than a specific amount, and controls the second transportation roller to transport the print medium to the print medium ejection opening at a second speed slower than the first speed when the amount of slack measured by the slack amount detector is less than the specific amount.

7. A computer-readable medium embodying a program of instructions executable by a computer for carrying out a printer control method, comprising instructions for the steps of:

(a) printing to a print medium;

(b) transporting the print medium printed in step (a) toward a print medium ejection opening;

(c) pausing the transportation of the print medium, so as to produce slack in the print medium;

(d) cutting the print medium to separate the print medium printed in step (a) from the remaining part of the print medium; and (e) resuming the transportation of the print medium toward the print medium ejection opening, before completion of step (d).

8. A computer-readable medium according to claim 7, wherein instructions for step (e) comprise instructions for the steps of:

(e)(1) measuring an amount of slack produced in the print medium;

(e)(2) comparing the amount of slack measured in step (e)(1) with a specific value;

(e)(3) resuming transportation of the print medium toward the print medium ejection opening at a first speed if the amount of slack measured in step (e)(1) is more than the specific value; and (e)(4) resuming transportation of the print medium toward the print medium ejection opening at a second speed slower than the first speed if the amount of slack measured in step (e)(1) is less than the specific value.

9. A computer-readable medium according to claim 8, further comprising instructions for the step of:

(f) changing, after completion of step (d), the transportation speed of the print medium set in step (e)(4) to the first speed.

10. A computer-readable medium according to claim 7, wherein:

in step (c), the stopping of the print medium is accomplished by stopping rotation of an ejection roller disposed upstream of the print medium ejection opening, and in step (e), the releasing and resuming of print medium transportation are accomplished by starting rotation of the ejection roller.

11. A printer for printing on a continuous recording medium, comprising:

a first transportation roller for transporting a printed area of the continuous medium toward an exit of the printer;

a second transportation roller, disposed adjacent to the exit, for transporting the printed area of the continuous medium through the exit;

a cutter for cutting the continuous medium in response to a command to cut the continuous medium;

a sensor for detecting that a leading edge of the continuous medium is adjacent to the exit; and a controller for suspending transportation operation by the second transportation roller without suspending transportation operation by the first transportation roller when the sensor detects that the leading edge of the continuous medium is adjacent to the exit, for suspending transportation operation by the first transportation roller when printing on the continuous medium is completed, and for resuming transportation operation by the second transportation roller prior to completing the cutting of the continuous medium when the command to cut the continuous medium is detected.

12. A printer, comprising:

a print head for printing on roll paper;

a cutter for cutting a portion of the roll paper which has been printed on by the print head;

a second transportation roller for transporting the portion of the roll paper that has been cut by the cutter; and a first transportation roller for advancing the uncut paper toward the second transportation roller while the uncut paper is printed on;

wherein, upon arrival of a leading edge of the printed on but as-of-yet uncut portion of the paper at the second transportation roller, the second transportation roller stops and supports the paper in a sandwiched manner, and then a predetermined length of the paper is advanced toward the second transportation roller by the first transportation roller; and wherein, upon completion of printing on the paper by the print head, the advancing operation by the first transportation roller is suspended and the transportation operation by the second transportation roller is started before the cutting operation by the cutter is completed.

* * * * *